US007544410B2

(12) United States Patent
Lengauer et al.

(10) Patent No.: US 7,544,410 B2
(45) Date of Patent: Jun. 9, 2009

(54) HARD METAL OR CERMET BODY AND METHOD FOR PRODUCING THE SAME

(75) Inventors: Walter Lengauer, Vienna (AT); Vera Ucakar, Vienna (AT); Klaus Dreyer, Essen (DE); Dieter Kassel, Witten (DE); Hans Werner Daub, Köln (DE)

(73) Assignee: Kennametal Widia Produktions GmbH & Co. KG, Essen (DE)

( * ) Notice: Subject to any disclaimer, the term of this patent is extended or adjusted under 35 U.S.C. 154(b) by 468 days.

(21) Appl. No.: 10/572,000

(22) PCT Filed: May 14, 2004

(86) PCT No.: PCT/DE2004/001016

§ 371 (c)(1),
(2), (4) Date: Mar. 10, 2006

(87) PCT Pub. No.: WO2005/026400

PCT Pub. Date: Mar. 24, 2005

(65) Prior Publication Data

US 2007/0042222 A1 Feb. 22, 2007

(30) Foreign Application Priority Data

Sep. 12, 2003 (DE) ..... 103 42 364

(51) Int. Cl.
*B32B 9/00* (2006.01)
*C22C 29/00* (2006.01)

(52) U.S. Cl. ..... 428/216; 427/255.11; 427/255.21; 427/255.28; 427/314; 427/331; 427/419.1; 427/419.7; 428/336; 428/472; 428/697; 428/698; 428/699

(58) Field of Classification Search ..... 427/255.11, 427/255.21, 255.28, 314, 331, 419.1, 419.7; 428/216, 336, 457, 469, 472, 697, 698, 699
See application file for complete search history.

(56) References Cited

U.S. PATENT DOCUMENTS

| | | | | | |
|---|---|---|---|---|---|
| 4,276,096 | A | * | 6/1981 | Kolaska et al. | 148/317 |
| 4,963,321 | A | * | 10/1990 | Saitoh et al. | 419/13 |
| 4,985,070 | A | * | 1/1991 | Kitamura et al. | 75/244 |
| 5,059,491 | A | * | 10/1991 | Odani et al. | 428/614 |
| 5,296,016 | A | * | 3/1994 | Yoshimura et al. | 428/545 |
| 5,856,032 | A | * | 1/1999 | Daub et al. | 428/698 |
| 6,110,603 | A | * | 8/2000 | Chen et al. | 428/564 |
| 2005/0224958 | A1 | * | 10/2005 | Kassel et al. | 257/708 |

* cited by examiner

*Primary Examiner*—Archene Turner
(74) *Attorney, Agent, or Firm*—Larry R. Meenan

(57) ABSTRACT

A hard metal or cermet body has a 2 to 100 μm thick first layer having a binder metal proportion of 2 to 25 mass % and up to 25 volume % of a nitride or carbonitride of one or more metals of Group IVa of the periodic system or up to 10 volume % of a carbide or carbonitride of V, Nb, Ta or Cr, balance WC, whereby the amount of nitride, carbonitride or carbide of the afore-mentioned metals amounts to at least 0.01 volume %. Under the first layer is a 2 to 40 μm thick second layer with an enhanced nitrogen proportion relative to the first layer, is disposed. Thereunder is a transition zone with a thickness of 2 to 100 μm in which the composition gradually changes to a homogeneous composition in the inner core of the hard metal or cermet body.

12 Claims, No Drawings

HARD METAL OR CERMET BODY AND METHOD FOR PRODUCING THE SAME

CROSS REFERENCE TO RELATED APPLICATIONS

This application is the U.S. national phase of PCT application PCT/DE2004/001016, filed 14 May 2004, published 24 Mar. 2005 as WO 2005/026400, and claiming the priority of German patent application 10342364.8 itself filed 12 Sep. 2003.

FIELD OF THE INVENTION

The invention relates to a hard metal or cermet body with a hard metal phase of WC and at least one carbide, nitride, carbonitride or oxycarbonitride of at least one of the elements of the Group IVa or Va of the periodic system and having a binder phase of Fe, Co and/or Ni with a proportion amounting to 3 to 25 mass % [weight %] with a single surface or with a plurality of mutually adjoining surfaces whereby beneath the single surface or at least one of the adjoining surfaces, there is a 2 to 100 μm thick first layer arranged that has a binder metal proportion of 2 to 25 mass % [weight %] and up to 25 volume % of a nitride or carbonitride of one or more metals of Group IVa of the periodic system and/or up to 10 volume % of a carbide and/or carbonitride of V, Nb, Ta and/or Cr.

The invention relates further to a method of making the aforedescribed body that after sintering or during sintering can be subjected to a first treatment to produce the aforementioned layer.

BACKGROUND OF THE INVENTION

In DE 197 52 289 C1, based upon teachings from diverse literature sources, a binder reach zone that has a reduced mixed carbide level [mixed carbide poor zone] is provided proximal to the surface and having a significant influence on the ductility of the substrate body and the adhesion thereto of a coating applied to this substrate body. The transport use of this zone of the cubic missed carbide phase is carried out via a nitrification process by the introduction of nitrogen that can be depleted in a subsequent vacuum treatment and gives rise to a preferred solubilization and diffusion transport of the mixed carbide phase in the binder metal. For the production of the boundary zone or gradient structure of such a substrate body, various methods have been proposed:

for example, a nitrification treatment can be carried out on the hard metal below the melting point of the binder phase whereby the body can then be heated under vacuum to the sintering temperature. The nitrogen that is required for the nitrification can be supplied by a nitrogen atmosphere or also in the form of nitrides or carbonitrides that are admixed with the hard material carbide and from a hard metal mixture additive. The sintering is carried out under vacuum so that a gradient zone formation can arise. The gradient zone can also be obtained by subjecting the hard metal in conjunction with the sintering to a nitrogen treatment under elevated temperature during sintering in the temperature range of about 1150° C. to a maximum of 1300° C. If an alternative thereto, the sintering of the hard metal can be carried out by a dewaxing at a temperature of up to 600° C., retaining it at this temperature, then heating it to the sintering temperature and carrying out a vacuum sintering at 0.1 to 100 Pa and subsequently sintering at under pressure. After cooling down of the hard metal shaped body to a temperature below 1280° C., the sintered body is subjected to a pressure treatment with a nitrogen atmosphere at 1 to 10 MPa and a subsequent vacuum treatment at 10 to 100 Pa.

DE 197 52 289 C1 describes the drawback that a subsequent mechanical finish machining of the substrate body to produce its final contour with at least partial machining away of the boundary zone causes the gradient zone and its positive properties to be wholly or partly lost. To overcome this drawback, it is proposed in DE 197 52 289 to subsequently treat the substrate body after finish machining in vacuum at about 600 to 1300° C. over a time period of up to 150 min. On the mechanically machined surface, this can result in renewal of the zone that is enriched with the binder metals and is free from cubic mixed carbide. The thickness of this region amounts to 5 to 35 μm.

OBJECT OF THE INVENTION

It is the object of the present invention to improve the hard metal or cermet body described at the outset with respect to its wear properties. Especially the wear resistance of such a hard metal or cermet body is to be improved so that it can be used as a machining tool.

SUMMARY OF THE INVENTION

This object is achieved with a hard metal or cermet body having a hard material phase of WC and at least one carbide, nitride, carbonitride or oxycarbonitride of at least one of the elements of Group IVa or Group Va of the periodic system and a binder phase of Fe, Co and/or Ni with a proportion amounting to 3 to 25 mass % with a single surface or a plurality of mutually adjoining surfaces, whereby beneath the single surface or at least one of the plurality of adjoining surfaces, a) a 2 to 100 μm thick first layer is disposed that has a binder metal proportion of 2 to 25 mass % and up to 25 volume % of a nitride or carbonitride of one or more metals of Group IVa of the periodic system and/or up to 10 volume % of a carbide and/or carbonitride of V, Nb, Ta and/or Cr, balance WC, whereby the amount of nitride, carbonitride or carbide of the afore-mentioned metals amounts to at least 0.01 volume %, and which further includes b) under the first layer a 2 to 40 μm thick second layer with an enhanced nitrogen proportion relative to the first layer, is disposed and that is comprised substantially of nitrides and/or carbonitrides of the metals of the group IVa of the periodic system and includes phase proportions of up to 10 volume % of carbides, nitrides, carbonitrides or oxycarbonitrides of the elements W, Mo, V, Ta, Nb, Cr and/or a proportion solubilized in the hard material phase of up to 5 mass % V, Nb, Ta and up to 2 mass % Cr, Mo, W and that contains up to 15 mass % binder, whereby the amount of the aforementioned phase proportions make up at least 0.01 volume % and/or the amount of the proportion dissolved in the hard material phase amounts to at least 0.01 mass %, c) and that under the second layer a transition zone is arranged with a thickness of 2 to 100 μm in which the composition gradually changes to a homogeneous composition in the inner core of the hard metal or ceramic body.

According to the invention, the hard metal or cermet body has below a 2 to 100 μm thick first layer with increased binder content and a reduced proportion of mixed carbide, a further 2 to 40 μm thick second layer that has an increased nitrogen content than the first layer and that consists substantially of nitrides and/or carbonitrides of the metals of group IVa of the periodic system and phase proportions of up to 20 volume % of carbides, nitrides, carbonitrides or oxycarbonitrides of the elements W, Mo, V, Ta, Nb, Cr and/or a proportion of up to 5 mass % [weight %] V, Nb, Ta soluble in the hard material phase and up to 2 mass % Cr, Mo, W and up to 15 mass % binder. Below this second layer, there is found a transition zone with a thickness of 2 to 100 μm in which the composition gradually changes to a homogeneous composition in the interior of the core of the hard metal or cermet body. In the first layer, therefore, a relatively ductal and abrasive resistant zone is produced with a high WC content while in the second layer lying there below, a diffusion resistant, hard layer with higher nitride or carbonitride proportions are provided.

According to a further feature of the invention, the mentioned first layer comprises only up to 2 mass % of a carbide or carbonitride of at least one of the metals V, Nb, Ta and/or chromium.

Preferably, the first layer consists of a composition comprised of 4 to 15 mass % or 7 to 22 volume % of binder metal or binder metals, 80 to 96 mass % or 66 to 93 volume % WC and 0 to 5 mass % or 0 to 12 volume % TiCN and/or TiN. The total quality of the aforementioned substances provides 100 mass % or 100 volume %.

The second layer is comprised preferably of 3 to 15 mass % or 2 to 15 volume % of a binder metal or binder metals, 0 to 50 mass % or 0 to 30 volume % WC and 35 to 98 mass % or 55 to 98 volume % TiCN or TiN, whereby the total quality of binder metal WC and TiCN and/or TiN gives 100 mass % or 100 volume %.

Preferably, the nitrogen content in the above mentioned second layer amounts to 8 to 22 mass % when the nitride is present in this layer exclusively as the metal nitride. The nitride proportion drops to the extent that a metal carbonitride is used in that nitrogen is replaced by carbon. By having about half (up to 50 atomic %) of the nitrogen provided by TiCN, the nitrogen content of the second layer is thereby minimized and preferably is about half, namely at 4 to 22 mass %.

Alternatively, the objects are achieved with a hard metal or cermet body with a hard material phase of WC and at least one carbide, nitride, carbonitride or oxycarbonitride of at least one of the elements of Group IVa of the periodic system and with a binder phase of Fe, Co and/or Ni whose proportion amounts to 3 to 25 mass % wherein below the single surface or at least one surface a 2 to 40 μm thick layer s arranged that is comprised substantially of nitrides and/or carbonitrides of the metals of Group IVa of the periodic system that contains phase proportions up to 10 volume % of carbides, nitrides, carbonitrides or oxycarbonitrides of the elements W, Mo, V, Ta, Nb, Cr and/or a proportion dissolved in the hard material phase of up to 5 mass % V, Nb, Ta and up to 2 mass % Cr, Mo, W and up to 15 mass % of a binder and in which under the second layer a transition zone with a thickness of 2 to 100 μm is arranged in which the composition gradually changes to a homogeneous composition in the core interior of the hard metal or cermet body. With this body, the binder metal enriched and mixed carbide poor first layer is ground away at one or more surfaces, is etched away or is removed by other processes so that the hard metal or cermet beneath the surface comprises a first layer structure having 4 to 15 mass % or 7 to 22 volume % of a binder metal or of binder metals 80 to 96 mass % or 66 to 93 volume % WC and 0 to 5 mass % or 0 to 12 volume % TiCN and/or TiN, whereby the total amount of binder metals, WC and TiCN and/or TiN amounts to 100 mass % or 100 volume %.

In accordance with a further feature of the invention, the hard metal or cermet body can additionally be provided on at least one surface with a single layer or multilayer coating. This coating can be comprised of carbides, nitrides, carbonitrides, oxides, oxynitrides of the elements of Group IVa, Group Va and Group IVa of the periodic system or also $Al_2O_3$, $ZrO_2$, $HFO_2$, AlON or carbon, preferably as diamond, or molybdenum sulfide or tungsten sulfide. The number of additional layers, applied for example by means of PVD [plasma vapor deposition] or CVD [chemical vapor deposition] and the choice of the layer compositions will depend upon the application intended for the article.

The production of the aforedescribed hard metal or cermet body fabricated by powder-metallurgical methods is, following sintering or during sintering subjected to a first heat treatment to produce a binder metal enriched 2 to 100 μm thick layer and then is treated additionally in a heat treatment with a nitrogen atmosphere under a nitrogen pressure of 50 mbar ($5\times10^3$ Pa) to 100 bar ($10^7$ Pa) below the eutectic, preferably at 1000° C. to 1200° C. As a result, the binder metal enriched and mixed carbide depleted first layer retains its composition substantially unaltered. During the heat treatment under nitrogen, nitrogen is transported into the interior of the body while simultaneously the outer first layer forms a 2 to 100 μm thick diffusion barrier for titanium and other metals that may be present in the body and may have an affinity for nitrogen so that they cannot travel outwardly. The first layer, proximal to the surface, has thus the effect of a membrane that is permeable to nitrogen from the exterior inwardly but that simultaneously blocks a diffusion of metals that have an affinity for hydrogen outwardly. This membrane like effect arises, however, only at the temperature range below the eutectic, namely, at 1000 to 1200° C. At higher temperatures titanium or other nitrogen-affinity metals can diffuse in the direction of the substrate surface and can form corresponding nitrides at boundary zones proximal to the surface. At lower temperatures than 1000° C., the nitrogen diffusion is slowed so that the desired effect of nitrogen enrichment in the second layer can practically no longer arise. The maintenance of the temperature limits in the second heat treatment is thus decisive for the results desired with the method of the invention.

Alternatively, it is also possible, after the first treatment step that gives rise to a mixed carbide reduction and binder metal enrichment in a first layer, to remove the layer that results below at least one surface by grinding, etching or another method before the body is subjected to a treatment in a nitrogen atmosphere under a nitrogen pressure of $5\times10^3$ Pa to $10^7$ Pa below the eutectic, preferably at a temperature between 1000 and 1200° C. At the locations to which the layer previously subjected to the first heat treatment has been removed, there is formed directly below the surface a nitrogen enriched layer of a thickness of 2 to 40 μm and with an elevated nitrogen proportion.

This method can be used especially for such substrate bodies that are to serve as machining tools, whereby beneath the exposed surface, either the layer sequences (a) through (c) are provided while on the machining or chip removal surface or at least in the region proximal to the cutting edge, the machining surface has only the layer sequence of (b) and (c). By comparison with such tools in which the substrate body is subjected only to the heat treatment processes known from the state of the art, the life in continuous cutting, measured by the degree of wear and the pitting depth can be increased by 8× to 10×.

The invention claimed is:

1. A hard metal or cermet body with a hard material phase of WC and at least one carbide, nitride, carbonitride or oxycarbonitride of at least one of the elements of Group IVa or Group Va of the periodic system and a binder phase of Fe, Co or Ni with a proportion amounting to 3 to 25 mass % with a single surface or a plurality of mutually adjoining surfaces, wherein beneath the single surface or at least one of the plurality of adjoining surfaces, a) a 2 to 100 μm thick first layer is disposed that has a binder metal proportion of 2 to 25 mass % and up to 25 volume % of a nitride or carbonitride of one or more metals of Group IVa of the periodic system or up to 10 volume % of a carbide or carbonitride of V, Nb, Ta or Cr, balance WC, whereby the amount of nitride, carbonitride or carbide of the aforementioned metals amounts to at least 0.01 volume %, and further wherein b) under the first layer a 2 to 40 μm thick second layer with an enhanced nitrogen proportion relative to the first layer, is disposed and that is comprised substantially of nitrides or carbonitrides of the metals of the Group IVa of the periodic system and includes phase proportions of up to 10 volume % of carbides, nitrides, carbonitrides or oxycarbonitrides of the elements W, Mo, V, Ta, Nb, Cr or a proportion solubilized in the hard material phase of up to 5 mass % V, Nb, Ta and up to 2 mass % Cr, Mo, W and that contains up to 15 mass % binder, whereby the amount of the aforementioned phase proportions make up at least 0.01 volume % or the amount of the proportion dissolved in the hard material phase amounts to at least 0.01 mass %, c) and that under the second layer a transition zone is arranged with a thickness of 2 to 100 μm in which the composition gradually changes to a homogeneous composition in the inner core of the hard metal or cermet body.

2. The hard metal or cermet body according to claim 1 wherein the first layer has according to (a) up to 2 mass % of carbides or carbonitrides of one of the metals V, Nb, Ta and/or or Cr.

3. The hard metal or cermet body according to claim 2 wherein the first layer according to (a) comprises 4 to 15 mass % or 7 to 22 volume % of a binder metal or of binder metals 80 to 96 mass % or 66 to 93 volume % WC and 0 to 5 mass % or 0 to 12 volume % TiCN or TiN, whereby the total amount of binder metals, WC and TiCN or TiN amounts to 100 mass % or 100 volume %.

4. The hard metal or cermet body according to claim 1 wherein the second layer according to (b) comprises 3 to 15 mass % or 2 to 15 volume % of a binder metal or of binder metals 0 to 50 mass % or 0 to 30 volume % WC and 35 to 98 mass % or 55 to 98 volume % TiCN or TiN, whereby the total amount of binder metals, WC and TiCN or TiN amounts to 100 mass % or 100 volume %.

5. The hard metal or cermet body according to claim 1 wherein the nitrogen content in the second layer according to (b) amounts to 8 to 22 mass % when bound nitrogen in this layer is present exclusively as a metal nitride and the nitrogen content is proportionally less corresponding to the amount to which nitrogen atoms are replaced in metal carbonitrides.

6. A hard metal or cermet body with a hard material phase of WC and at least one carbide, nitride, carbonitride or oxycarbonitride of at least one of the elements of Group IVa of the periodic system and with a binder phase of Fe, Co or Ni whose proportion amounts to 3 to 25 mass % wherein below the single surface or below at least one surface a 2 to 40 μm thick layer is arranged that is comprised substantially of nitrides or carbonitrides of the metals of Group IVa of the periodic system that contains phase proportions up to 10 volume % of carbides, nitrides, carbonitrides or oxycarbonitrides of the elements W, Mo, V, Ta, Nb, Cr or a proportion dissolved in the hard material phase of up to 5 mass % V, Nb, Ta and up to 2 mass % Cr, Mo, W and up to 15 mass % of a binder and in which under the second layer a transition zone with a thickness of 2 to 100 μm is arranged in which the composition gradually changes to a homogeneous composition in the core interior of the hard metal or cermet body.

7. A hard metal or cermet body according to claim 1 wherein at least one surface has a single layer or multilayer coating comprised of carbides, nitrides, carbonitrides or oxycarbonitrides of elements of Group IVa through Group VIa of the periodic system, $Al_2O_3$, $ZrO_2$, $HfO_2$, AlON or diamond, or Mo or W sulfides.

8. A method of making a hard metal or cermet body according to claim 1 in which after sintering or during sintering the body is subjected to a first heat treatment to produce the layer with the composition a), wherein following this heat treatment, the body is treated in a nitrogen atmosphere under an end tube pressure of $5\times10^3$ Pa to $10^7$ Pa below the eutectic.

9. A method of making a hard metal or cermet body according to claim 8 in which following sintering or during sintering a first heat treatment is carried out to produce the layer with the composition a), wherein at least partially or completely the first 2 to 100 μm thick layer with the composition (a) is removed and thereafter the body is treated in a nitrogen atmosphere under an end tube pressure of $5\times10^3$ Pa to $10^7$ Pa below the eutectic.

10. A method of making a hard metal or cermet body according to claim 8 wherein the substrate body is then coated with one or more layers by means of CVD or PVD.

11. A method of making a hard metal or cermet body according to claim 8 wherein following this heat treatment, the body is treated in a nitrogen atmosphere under an end tube pressure of $5\times10^3$ Pa to $10^7$ Pa below the eutectic, at 1000° C. to 1200° C.

12. A method of making a hard metal or cermet body according to claim 9 wherein the body is treated in a nitrogen atmosphere under an end tube pressure of $5\times10^3$ Pa to $10^7$ Pa below the eutectic, at 1000° C. to 1200° C.

* * * * *